US007115830B1

(12) United States Patent
Weister et al.

(10) Patent No.: US 7,115,830 B1
(45) Date of Patent: Oct. 3, 2006

(54) REDUNDANT PIVOT TRIP LATCH

(75) Inventors: Nathan James Weister, Darlington, PA (US); Douglas Charles Marks, Murrysville, PA (US); Mark Allen McAfee, Georgetown, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/147,644

(22) Filed: Jun. 8, 2005

(51) Int. Cl.
*H01H 5/00* (2006.01)

(52) U.S. Cl. ..... 200/400

(58) Field of Classification Search ..... 200/400, 200/401, 500, 501
See application file for complete search history.

(56) References Cited

U.S. PATENT DOCUMENTS 5,148,913 A * 9/1992 Bonnardel et al. ..... 200/400
6,064,021 A * 5/2000 Wehrli et al. ..... 200/400
6,072,136 A 6/2000 Wehrli, III et al.
6,080,947 A * 6/2000 Ulerich et al. ..... 200/308
6,160,234 A * 12/2000 Wehrli et al. ..... 200/400
6,316,739 B1 * 11/2001 Ohtsuka et al. ..... 200/400
6,437,269 B1 * 8/2002 Rakus ..... 200/400
6,515,245 B1 * 2/2003 Marin-Pache et al. ..... 200/400

* cited by examiner

*Primary Examiner*—Michael A. Friedhofer
(74) *Attorney, Agent, or Firm*—Martin J. Moran

(57) ABSTRACT

A trip mechanism having a hatchet plate disposed on a pivot pin assembly having a pivot pin member with at least three pivoting surfaces. First and second pivoting surfaces are located where the pivot pin member engages the supporting side plates. Thus, the pivot pin assembly may rotate in the traditional manner, i.e., both the hatchet plate and the pivot pin assembly rotate between the side plates. An additional pivoting surface is located where the hatchet plate engages the pivot pin assembly.

24 Claims, 12 Drawing Sheets

REDUNDANT PIVOT TRIP LATCH

BACKGROUND OF THE INVENTION

1. Field of the Invention

This invention relates to electrical switching apparatus (es) such as protective devices and switches used in electric power distribution circuits carrying large currents. More particularly, it relates to a trip mechanism having at least two modes of rotation about at least three pivoting surfaces.

2. Background Information

Electrical switching apparatus for opening and closing electric power circuits typically utilize an energy storage device in the form of one or more large springs to close the contacts of the device into the large currents which can be drawn in such circuits. Such electrical switching apparatus includes power circuit breakers and network protectors which provide protection, and electric switches which are used to energize and deenergize parts of the circuit or to transfer between alternative power sources. These devices also include an open spring or springs which rapidly separate the contacts to interrupt current flowing in the power circuit. As indicated, either or both of the close spring and open spring can be a single spring or multiple springs and should be considered as either even though the singular is hereafter used for convenience. The open spring is charged during closing by the close spring which, therefore, must store sufficient energy to both overcome the mechanical and magnetic forces for closing as well as charging the open springs. Moreover, the close spring is required to have sufficient energy to close and latch on at least 15 times the rated current.

Both tension springs and compression springs have been utilized to store sufficient energy to close the contacts and to charge the open spring. The tension springs are easier to control, but the compression springs can store more energy. In either case, a robust operating mechanism is required to mount and control the charging and discharging of the spring. The operating mechanism typically includes a manual handle, and often an electric motor, for charging the close spring. It also includes a latch mechanism for latching the close spring in the charged state, a release mechanism for releasing the stored energy in the close spring, and an arrangement, a pole shaft for example, for coupling the released energy into the moving conductor assembly supporting the moving contacts of the switch.

The latch mechanism includes a hatchet plate that was fixed to a pivot pin. The pivot pin extended between, and was disposed within aligned openings in, two side plates. The pivot pin was structured to rotate within the aligned openings. While this configuration performs the desired function, if the pivot pin becomes fixed in one position, the hatchet plate may be prevented from rotating. For example, if, over an extended period of time, vibration caused the pivot pin openings to become deformed, the pivot pin may not rotate properly. This disadvantage could be overcome if the hatchet plate had more than one mode of rotation about the longitudinal axis of the pivot pin.

There is, therefore, a need for a pivot pin assembly that allows for more than one mode of rotation of a hatchet plate about the pivot pin.

There is a further need for a pivot pin assembly having at least three pivoting surfaces.

There is a further need for a pivot pin assembly that allows for more than one mode of rotation of a hatchet plate about the pivot pin which can be installed in existing circuit breakers.

SUMMARY OF THE INVENTION

These needs, and others, are met by the present invention which provides for a latch mechanism having a hatchet plate disposed on a pivot pin assembly having a pivot pin member with at least three pivoting surfaces. First and second pivoting surfaces are located where the pivot pin member engages the supporting side plates. Thus, the pivot pin may rotate in the traditional manner, i.e., both the hatchet plate and the pivot pin rotate between the side plates. An additional pivoting surface is located where the hatchet plate engages the pivot pin. Thus, if the pivot pin were to become unable to rotate, the hatchet plate could still rotate about the third pivoting surface. Additionally, because the hatchet plate is rotating about the axis of the pivot pin, the nature of pivoting motion is essentially identical to the motion create when the pivot pin rotates.

The pivot pin member may include additional elements, such as a hatchet plate bearing and a hatchet plate race. In this embodiment, the third pivoting surface is the outer surface of the hatchet plate bearing that engages the hatchet plate or the hatchet plate race. The hatchet plate race is, preferably a torus coupled to the hatchet plate. However, the hatchet plate race may be free to rotate, thus defining a fourth pivoting surface. Additionally, the hatchet plate bearing may also be a torus disposed on a cylindrical pivot pin member. In this configuration, the hatchet plate bearing may rotate on the pivot pin member, thus the inner surface of the hatchet plate bearing defines a fifth pivoting surface. Similarly, the pivot pin assembly may include side plate races disposed between the pivot pin member and the side plates. Where the side plate races are fixed to the side plates, the pivot pin member first and second pivoting surfaces engage the side plate races. The side plate races may, however, be free to rotate within the side plates. Thus, the outer sides of the side plate races define a sixth and seventh pivoting surfaces.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The invention will be described as applied to a power air circuit breaker; however, it also has application to other electrical switching apparatus for opening and closing electric power circuits. For instance, it has application to switches providing a disconnect for branch power circuits and transfer switches used to select alternate power sources for a distribution system. The major difference between a power circuit breaker and these various switches is that the circuit breaker has a trip mechanism which provides overcurrent protection. The invention could also be applied to network protectors which provide protection and isolation for distribution circuits in a specified area.

This invention may be used with the apparatus disclosed in U.S. Pat. No. 6,072,136, which is incorporated by reference. U.S. Pat. No. 6,072,136 provides a full description of the charging mechanism, as well as various other components of the circuit breaker, which are not relevant to the present invention.

Figure 1:
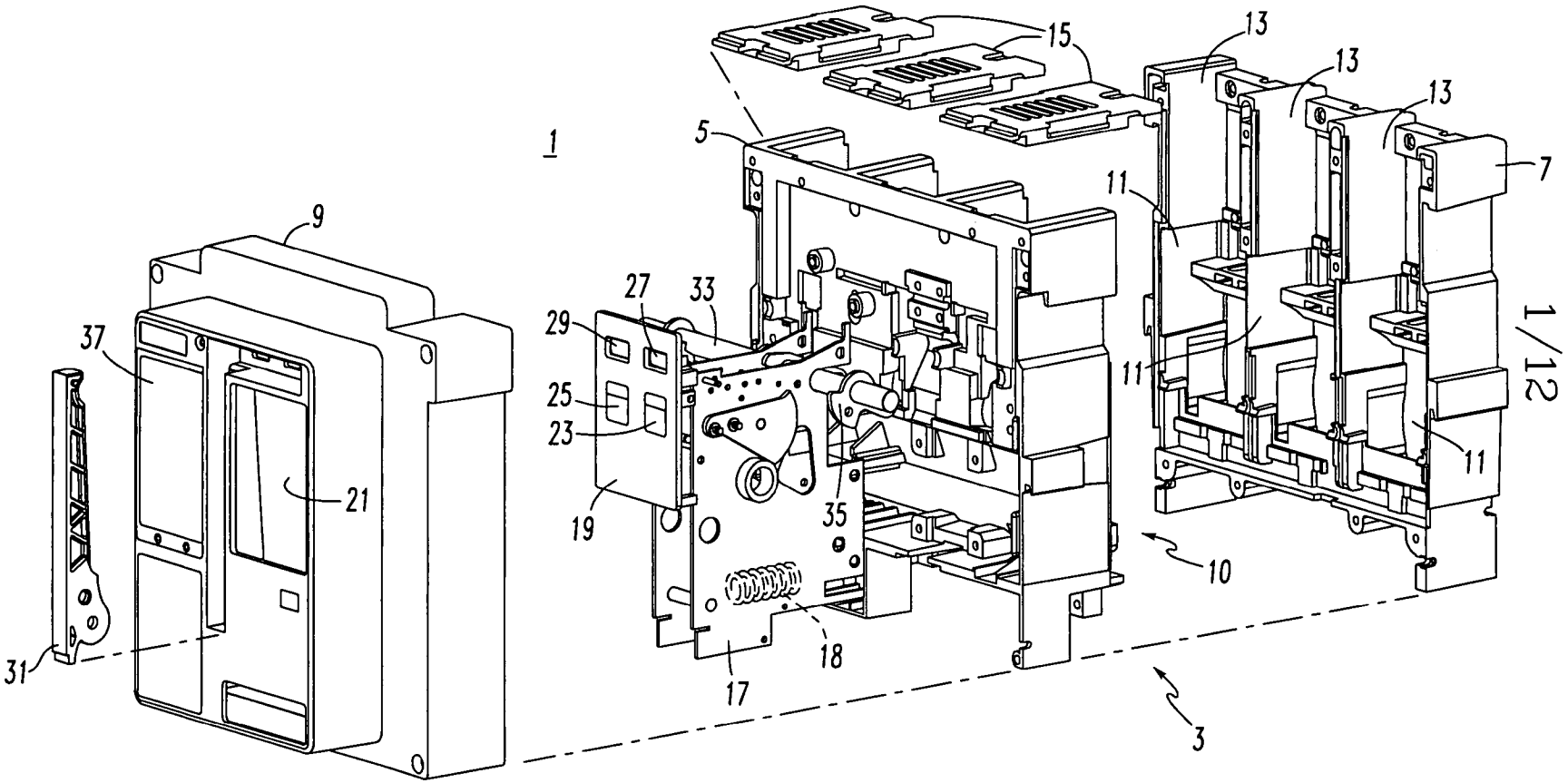
FIG. 1 is an exploded isometric view of a low voltage, high current power circuit breaker in accordance with the invention.

Referring to FIG. 1, the power air circuit breaker 1 of the invention has a housing 3 which includes a molded front casing 5 and a rear casing 7, and a cover 9. The exemplary circuit breaker 1 has three poles 10 with the front and rear casings 5, 7 forming three, pole chambers 11. Each pole 10 has an arc chamber 13 which is enclosed by a ventilated arc chamber cover 15.

Circuit breaker 1 has an operating mechanism 17 which is mounted on the front of the front casing 5 and is enclosed by the cover 9. The operating mechanism 17 has a face plate 19 which is accessible through an opening 21 in the cover. The operating mechanism 17 includes a large close spring 18 which is charged to store energy for closing the circuit breaker. Face plate 19 mounts a push to close button 23 which is actuated to discharge the close spring for closing the circuit breaker 1, and a push to open button 25 for opening the circuit breaker. Indicators 27 and 29 display the condition of the close spring and the open/closed state of the contacts, respectively. The close spring 18 is charged by operation of the charging handle 31 or remotely by a motor operator (not shown).

The common operating mechanism 17 is connected to the individual poles by a pole shaft 33 with a lobe 35 for each pole 10. As is conventional, the circuit breaker 1 includes an electronic trip unit 37 supported in the cover 9 which actuates the operating mechanism 17 to open all of the poles 10 of the circuit breaker 1 through rotation of the pole shaft 33 in response to predetermined characteristics of the current flowing through the circuit breaker 1.

Figure 2:
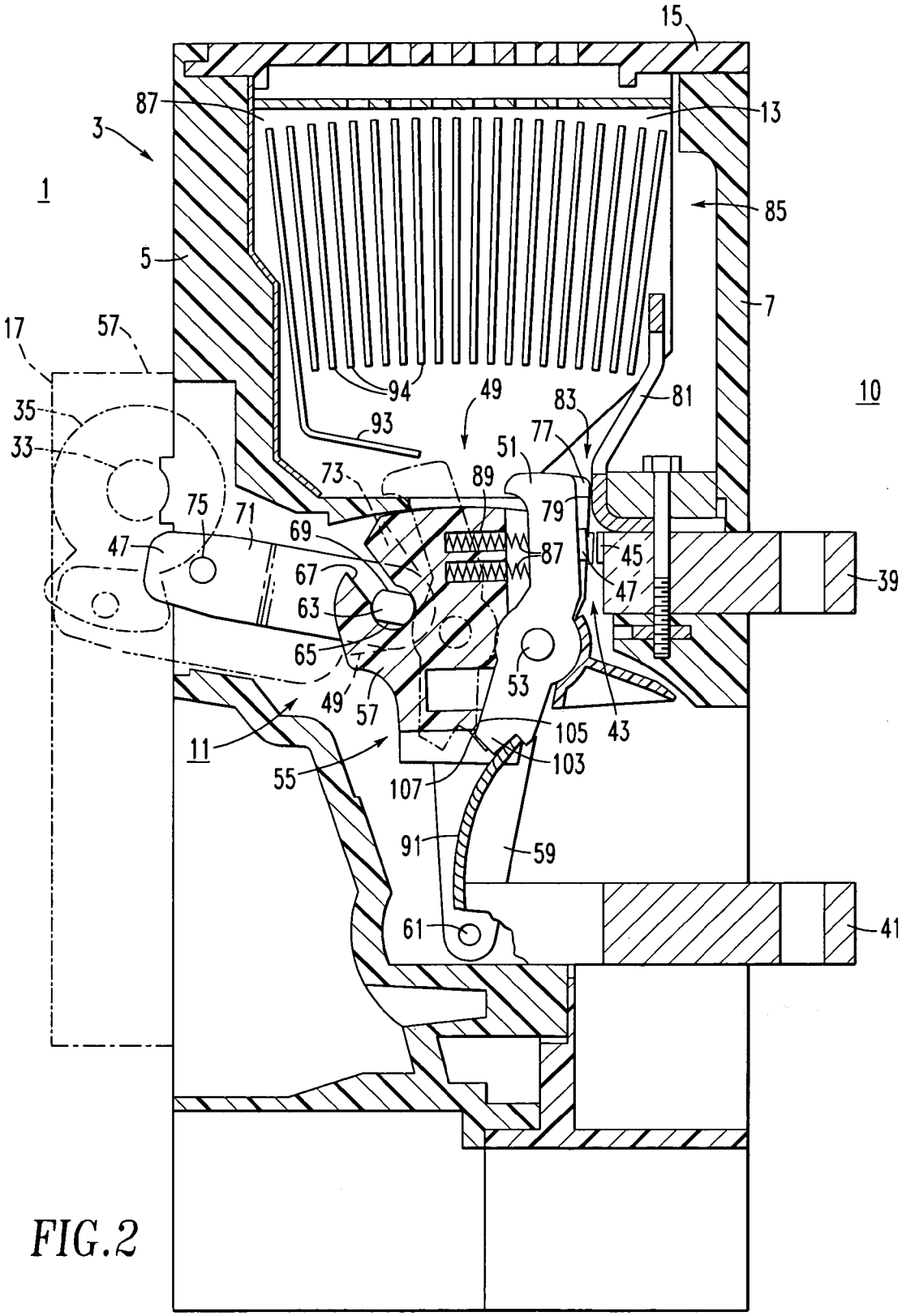
FIG. 2 is a vertical section through a pole of the circuit breaker of FIG. 1 shown as the contacts separate during opening.

FIG. 2 is a vertical section through one of the pole chambers 11. The pole 10 includes a line side conductor 39 which projects out of the rear casing 7 for connection to a source of ac electric power (not shown). A load conductor 41 also projects out of the rear casing 7 for connection typically to the conductors of the load network (also not shown).

Each pole 10 also includes a pair of main contacts 43 that include a stationary main contact 45 and a moveable main contact 47. The moveable main contact 47 is carried by a moving conductor assembly 49. This moving conductor assembly 49 includes a plurality of contact fingers 51 which are mounted in spaced axial relation on a pivot pin 53 secured in a contact carrier 55. The contact carrier 55 has a molded body 57 and a pair of legs 59 (only one shown) having pivots 61 rotatably supported in the housing 3.

The contact carrier 55 is rotated about the pivots 61 by the operating mechanism 17 which includes a drive pin 63 received in a transverse passage 65 in the carrier body 57 through a slot 67 to which the drive pin 63 is keyed by flats 69. The drive pin 63 is fixed on a drive link 71 which is received in a groove 73 in the carrier body. The other end of the drive link 71 is pivotally connected by a pin 75 to the associated lobe arm 35 on the pole shaft 33 similarly connected to the carriers (not shown) in the other poles of the circuit breaker 1. The pole shaft 33 is rotated by the operating mechanism 17.

A moving main contact 47 is fixed to each of the contact fingers 51 at a point spaced from the free end of the finger. The portion of the contact finger 51 adjacent the free end forms a moving arcing contact or "arc toe" 77. A stationary arcing contact 79 is provided on the confronting face of an integral arcing contact and runner 81 mounted on the line side conductor 39. The stationary arcing contact 79 and arc toe 77 together form a pair of arcing contacts 83. The integral arcing contact and runner 81 extends upward toward a conventional arc chute 85 mounted in the arc chamber 13.

The contact fingers 51 are biased clockwise as seen in FIG. 2 on the pivot pin 53 of the carrier 55 by pairs of helical compression springs 87 seated in recesses 89 in the carrier body 57. The operating mechanism 17 rotates the pole shaft 33 which, in turn, pivots the contact carrier 55 clockwise to a closed position (not shown) to close the main contacts 43. To open the contacts, the operating mechanism 17 releases the pole shaft 33 and the compressed springs 87 accelerate the carrier 55 in a counterclockwise direction to an open position (not shown). As the carrier 55 is rotated clockwise toward the closed position, the arc toes 77 contact the stationary arcing contacts 79 first. As the carrier 55 continues to move clockwise, the springs 87 compress as the contact fingers 51 rock about the pivot pin 53 until the main contacts 43 close. Further clockwise rotation to the fully closed position (not shown) results in opening of the arcing contacts 83 while the main contacts 43 remain closed. In that closed position, a circuit is completed from the line conductor 39 through the closed main contacts 43, the contact fingers 51, flexible shunts 91, and the load conductor 41.

To open the circuit breaker 1, the operating mechanism 17 releases the pole shaft 33 so that the compressed springs 87 accelerate the carrier 55 counterclockwise as viewed in FIG. 2. Initially, as the carrier 55 moves away from the line conductor 39, the contact fingers 51 rock so that the arcing contacts 83 close while the main contacts 43 remain closed. As the carrier 55 continues to move counterclockwise, the main contacts 43 open and all of the current is transferred to the arcing contacts 83 which is the condition shown in FIG. 2. If there is a sizeable current being carried by the circuit breaker 1 such as when the circuit breaker 1 trips open in response to an overcurrent or short circuit, an arc is struck between the stationary contacts 79 and the moveable arcing contacts or arc toes 77 as these contacts separate with continued counterclockwise rotation of the carrier 55. As the main contacts 43 have already separated, the arcing is confined to the arcing contacts 83 which preserves the life of the main contacts 43. The electromagnetic forces produced by the current sustained in the arc push the arc outward toward the arc chute 85 so that the end of the arc at the stationary contact 79 moves up the integral arcing contact and runner 81 and into the arc chute 85. At the same time, the rapid opening of the carrier 55 brings the arc toes 77 adjacent the free end of the arc top plate 93 as shown in phantom in FIG. 2 so that the arc extends from the arc toes 77 to the arc top plate 93 and moves up the arc top plate 93 into the arc plates 94 which break the arc up into shorter sections which are then extinguished.

Figure 3:
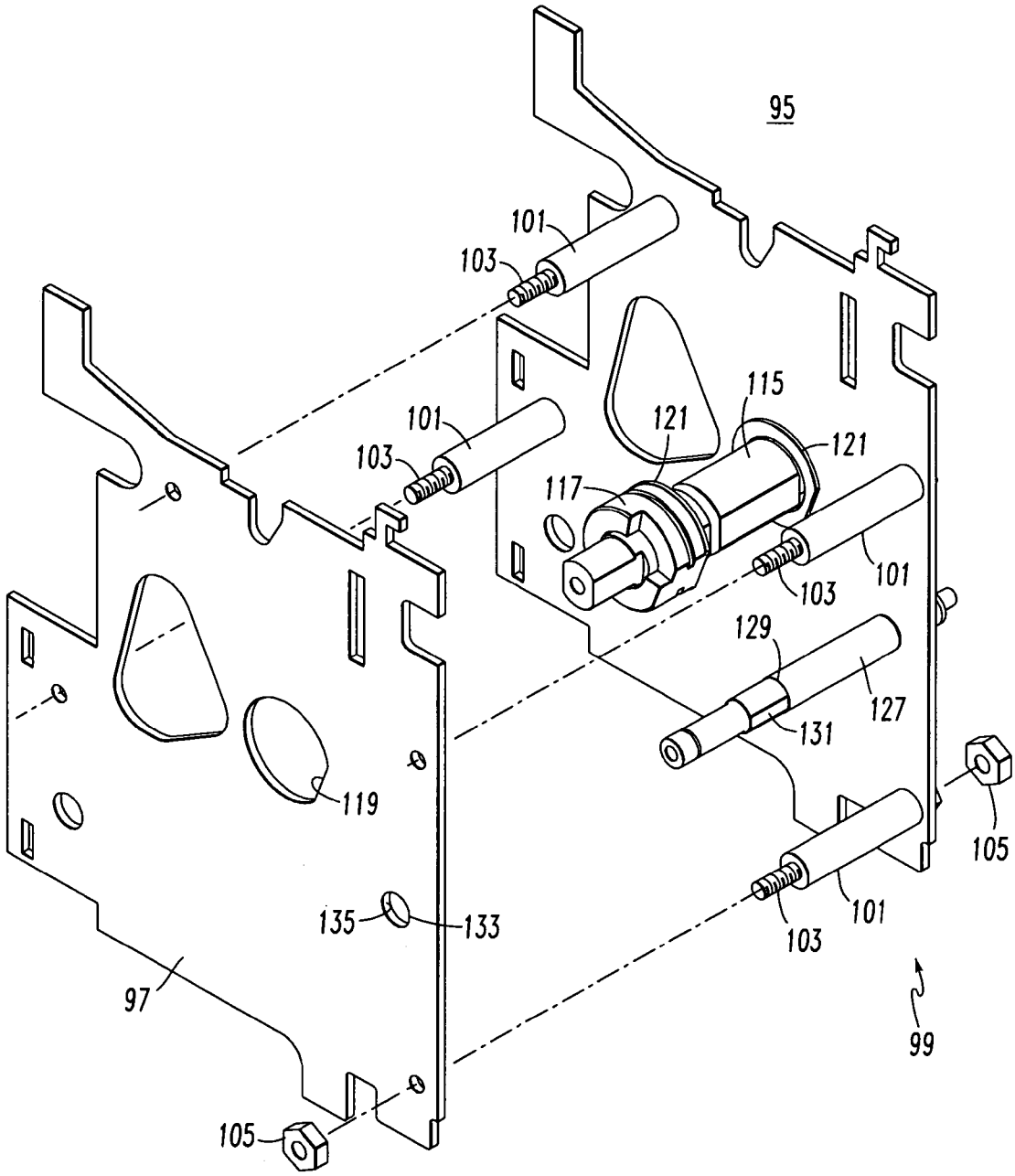
FIG. 3 is an exploded isometric view of a cage assembly which forms part of the operating mechanism of the circuit.
Figure 4:
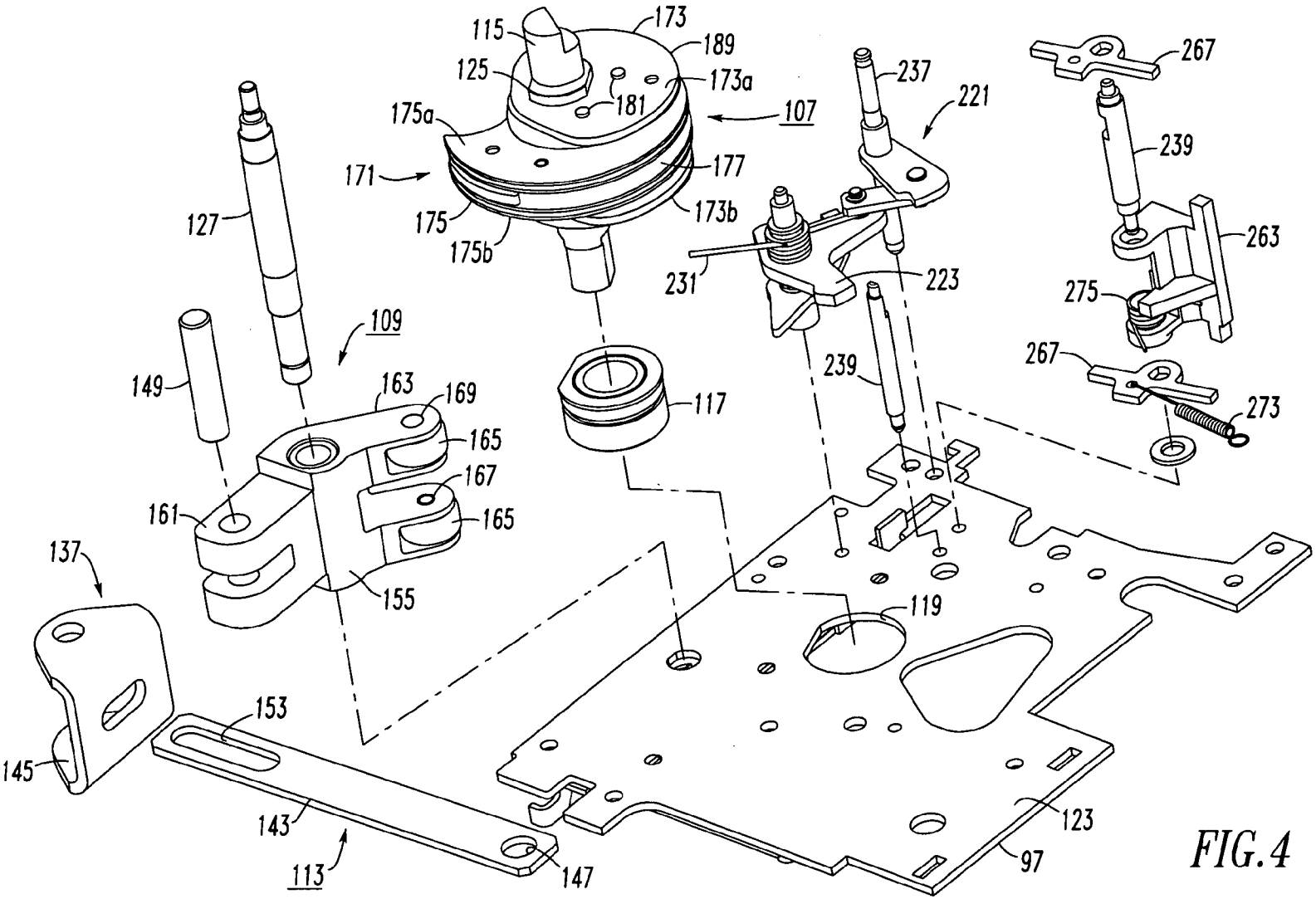
FIG. 4 is an exploded isometric view illustrating assembly of the operating mechanism.
Figure 5:
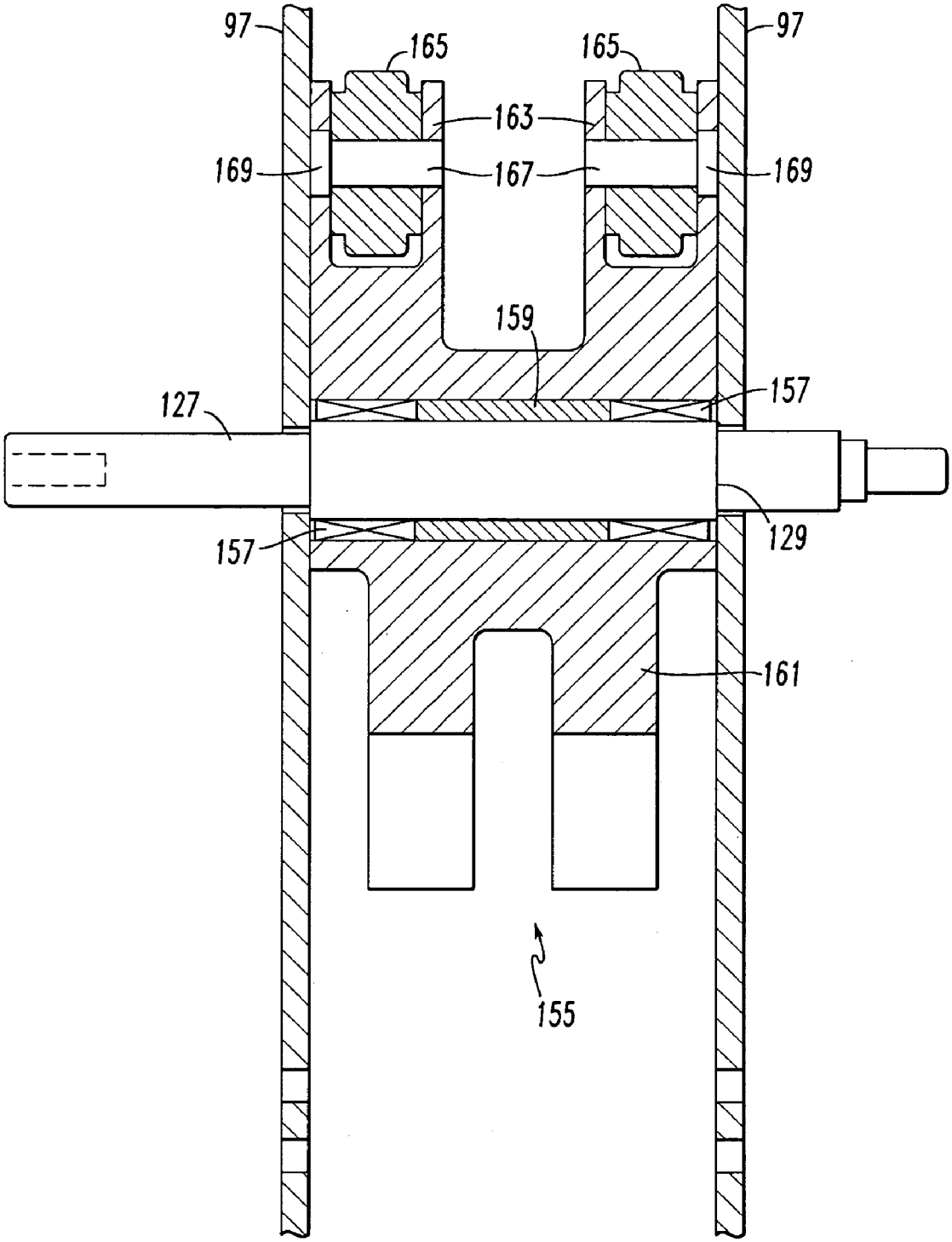
FIG. 5 is a partial vertical sectional view through an assembled operating mechanism taken through the rocker assembly.

The operating mechanism 17 is a self supporting module having a cage 95. As shown in FIG. 3, the cage 95 includes two side plates 97 which are identical and interchangeable. The side plates 97 are held in spaced relation by four elongated members 99 formed by spacer sleeves 101, and threaded shafts 103 and nuts 105 which clamp the side plates 97 against the spacer sleeves 101. Four major subassemblies and a large close spring 18 make up the power portion of the operating mechanism 17. The four major subassemblies are the cam assembly 107, the rocker assembly 109, the main link assembly 111 and a close spring support assembly 113. All of these components fit between the two side plates 97. Referring to FIGS. 3 and 4, the cam assembly 107 includes a cam shaft 115 which is journaled in a non-cylindrical bushing 117 and a spring clutch collar 222 (See FIG. 12) which are seated in complementary non-cylindrical openings 119 in the side plates 97. The bushing 117 has a flange 121 which bears against the inner face 123 of the side plate 97, and the cam shaft 115 has shoulders 125 which position it between the bushing 117 and the collar 222 so that the cam shaft 115 and the bushing 117 are captured between the side plates 97 without the need for fasteners. Similarly, a rocker pin 127 of the rocker assembly 109 has shoulders 129 which capture it between the side plates 97 as seen in FIGS. 3–5. Flats 131 on the rocker pin 127 engage similar flats 133 in openings 135 in the side plates 97 to prevent rotation of the rocker pin 127. The cam shaft 115 and rocker pin 127 add stability to the cage 95 which is self-aligning and needs no special fixturing for alignment of the parts during assembly. As the major components are "sandwiched" between the two side plates 97, the majority of the components need no additional hardware for support. As will be seen, this sandwich construction simplifies assembly of the operating mechanism 17.

Figure 6:
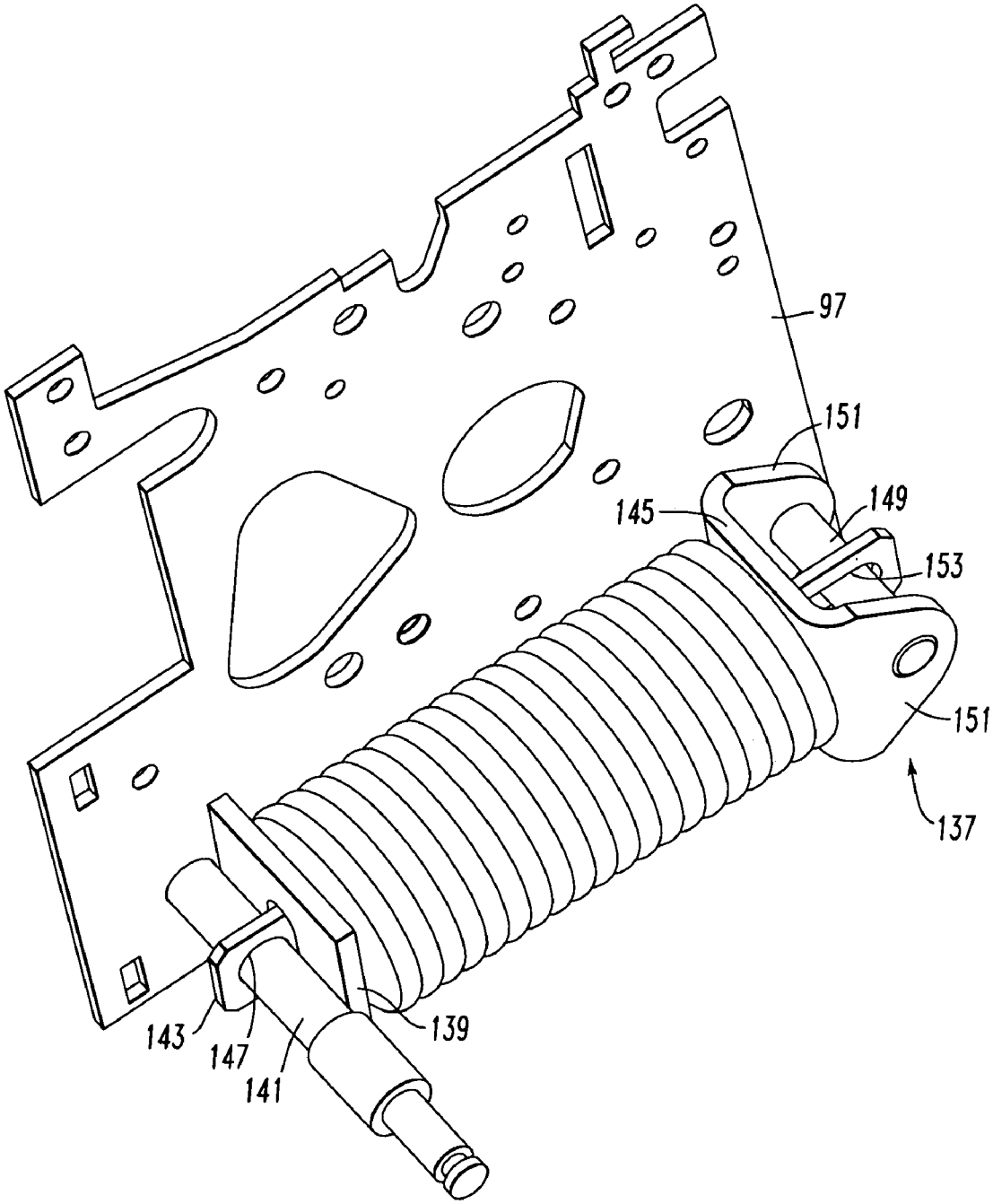
FIG. 6 is an isometric view illustrating the mounting of the close spring which forms part of the operating mechanism.
Figure 7:
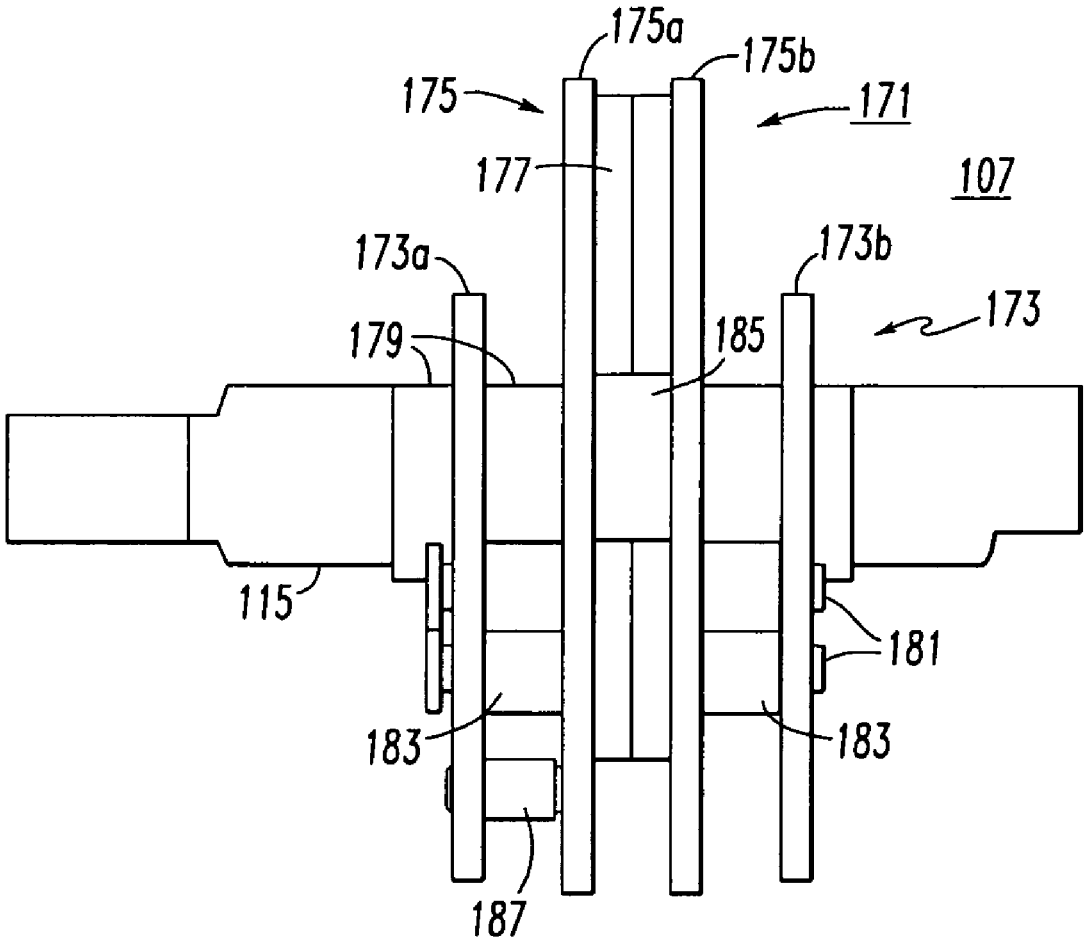
FIG. 7 is a side elevational view of the cam assembly which forms part of the operating mechanism.

The close spring 18 is a common, round wire, heavy duty, helical compression spring 87 closed and ground flat on both ends. A compression spring 87 is used because of its higher energy density than a tension spring. The helical compression close spring 18 is supported in a very unique way by the close spring support assembly 113 in order to prevent stress risers and/or buckling. In such a high energy application, it is important that the ends of the close spring 18 be maintained parallel and uniformly supported and that the spring be laterally held in place. As illustrated particularly in FIGS. 4 and 6, and also in FIGS. 8–11, this is accomplished by compressing the helical compression close spring 18 between a U-bracket 137 which is free to rotate and also drive the rocker assembly 109 at one end, and a nearly square spring washer or guide plate 139 which can pivot against a spring stop or support pin 141 which extends between the slide plates 97 at the other end. The close spring 18 is kept from "walking" as it is captured between the two side plates 97, and is laterally restrained by an elongated guide member 143 that extends through the middle of the spring, the guide plate 139 and the brace 145 of the U-bracket 137. The elongated guide member 143, in turn, is captured on one end by the support pin 141 which extends through an aperture 147, and on the other end by a bracket pin 149 which extends through legs 151 on the U-bracket 137 and an elongated slot 153 in the elongated member 143.

The rocker assembly 109 includes a rocker 155 pivotally mounted on the rocker pin 127 by a pair of roller bearings 157 which are captured between the side plates 97 and held in spaced relation by a sleeve 159 as best seen in FIG. 5. The rocker 155 has a clevis 161 on one end which pivotally connects the rocker 155 to the U-bracket 137 through the bracket pin 149. A pair of legs 163 on the other end of the rocker 155 which extend at an obtuse angle to the clevis 161, form a pair of roller devises which support rocker rollers 165. The rocker rollers 165 are pivotally mounted to the roller devises 161 by pins 167. These pins 167 have heads 169 facing outwardly toward the side plates 97 so that they are captured and retained in place without the need for any snap rings or other separate retainers. As the rocker 155 rocks about the rocker pin 127, the guide plate 139 rotates on the spring support pin 141 so that the loading on the close spring 18 remains uniform regardless of the position of the rocker 155. The close spring 18, guide plate 139 and spring support pin 141 are the last items that go into an operating mechanism 17 so that the close spring 18 can be properly sized for the application.

The U bracket pin 149 transfers all of the spring loads and energy to the rocker clevis 161 on the rocker 155. The translational loads on the rocker 155 are transferred into the non-rotating rocker pin 127 and from there into the two side plates 97 while the rocker 155 remains free to rotate between the side plates 97.

Referring to FIGS. 4–11, the cam assembly 107 includes, in addition to the cam shaft 115, a cam member 171. The cam member 171 includes a charge cam 173 formed by a pair of charge cam plates 173*a*, 173*b* mounted on the cam shaft 115. The charge cam plates 173*a*, 173*b* straddle a drive cam 175 which is formed by a second pair of cam plates 175*a*, 175*b*. A cam spacer 177 sets the spacing between the drive cam plates 175*a*, 175*b* while spacer bushings 179 separate the charge cam plates 173*a*, 173*b* from the drive cam plates 173*a*, 173*b*, 175*a*, 175*b* and from the side plates 97. The cam plates 173*a*, 173*b*, 175*a*, 175*b* are all secured together by rivets 181 extending through rivet spacers 183 between the plates. A stop roller 185 is pivotally mounted between the drive cam plates 175*a* and 175*b* and a reset pin 187 extends between the drive cam plate 175*a* and the charge cam plate 173*a*. The cam assembly 107 is a 360° mechanism which compresses the close spring 18 to store energy during part of the rotation, and which is rotated by release of the energy stored in the close spring 18 during the remainder of rotation. This is accomplished through engagement of the charge cam plates 173*a*, 173*b* by the rocker rollers 165. The preload on the close spring 18 maintains the rocker rollers 165 in engagement with the charge cam plates 173*a*, 173*b*. The charge cam 173 has a cam profile 189 with a charging portion 189*a* which at the point of engagement with the rocker rollers 165 increases in diameter with clockwise rotation of the cam member 171. The cam shaft 115 and therefore the cam member 171 is rotated either manually by the handle 31 or by an electric motor (not shown). The charging portion 189*a* of the charge cam profile 189 is configured so that a substantially constant torque is required to compress the close spring 18. This provides a better feel for manual charging and reduces the size of the motor required for automatic charging as the constant torque is below the peak torque which would normally be required as the spring approaches the fully compressed condition.

The cam profile 189 on the charge cam 173 also includes a closing portion 189*b* which decreases in diameter as the charge cam 173 rotates against the rocker rollers 165 so that the energy stored in the close spring 18 drives the cam member 171 clockwise when the mechanism is released.

The drive cam 175 of the cam member 171 has a cam profile 191 which, in certain rotational positions, is engaged by a drive roller 193 mounted on a main link 195 of the main link assembly 111 by a roller pin 197. The other end of the main link 195 is pivotally connected to a drive arm 199 on the pole shaft 33 by a pin 201. This main link assembly 111 is coupled to the drive cam 175 for closing the circuit breaker 1 by a trip mechanism 203 which includes a hatchet plate 205 pivotally mounted on a hatchet pivot pin assembly 207 supported by the side plates 97, as described in greater detail below, and biased counterclockwise by a spring 219. A banana link 209 is pivotally connected at one end to an extension on the roller pin 197 of the main link 111 and at the other end is pivotally connected to one end of the hatchet plate 205. The other end of the hatchet plate 205 has a latch ledge 211 which engages a trip D shaft 213 when the shaft is rotated to a latch position. With the hatchet plate 205 latched, the banana link 209 holds the drive roller 193 in engagement with the drive cam 175. In operation, when the trip D shaft 213 is rotated to a trip position, the latch ledge 211 slides off of the trip D shaft 213 and the hatchet plate 205 passes through a notch 215 in the trip D shaft 213 which repositions the pivot point of the banana link 209 connected to the hatchet plate 205 and allows the drive roller 193 to float independently of the drive cam 175.

Figure 8:
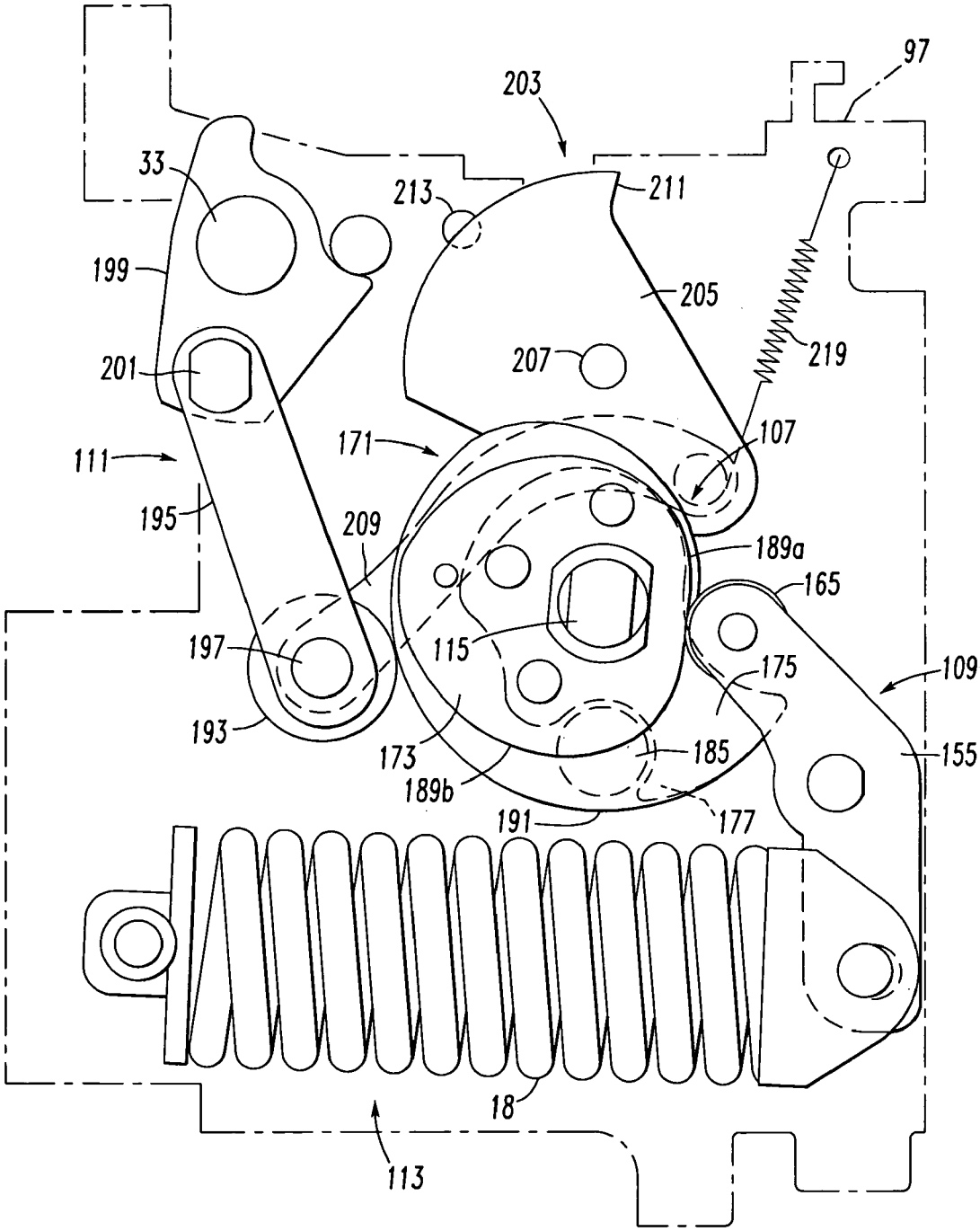
FIG. 8 is an elevational view illustrating the relationship of the major components of the operating mechanism shown with the contacts open and the close spring discharged.
Figure 9:
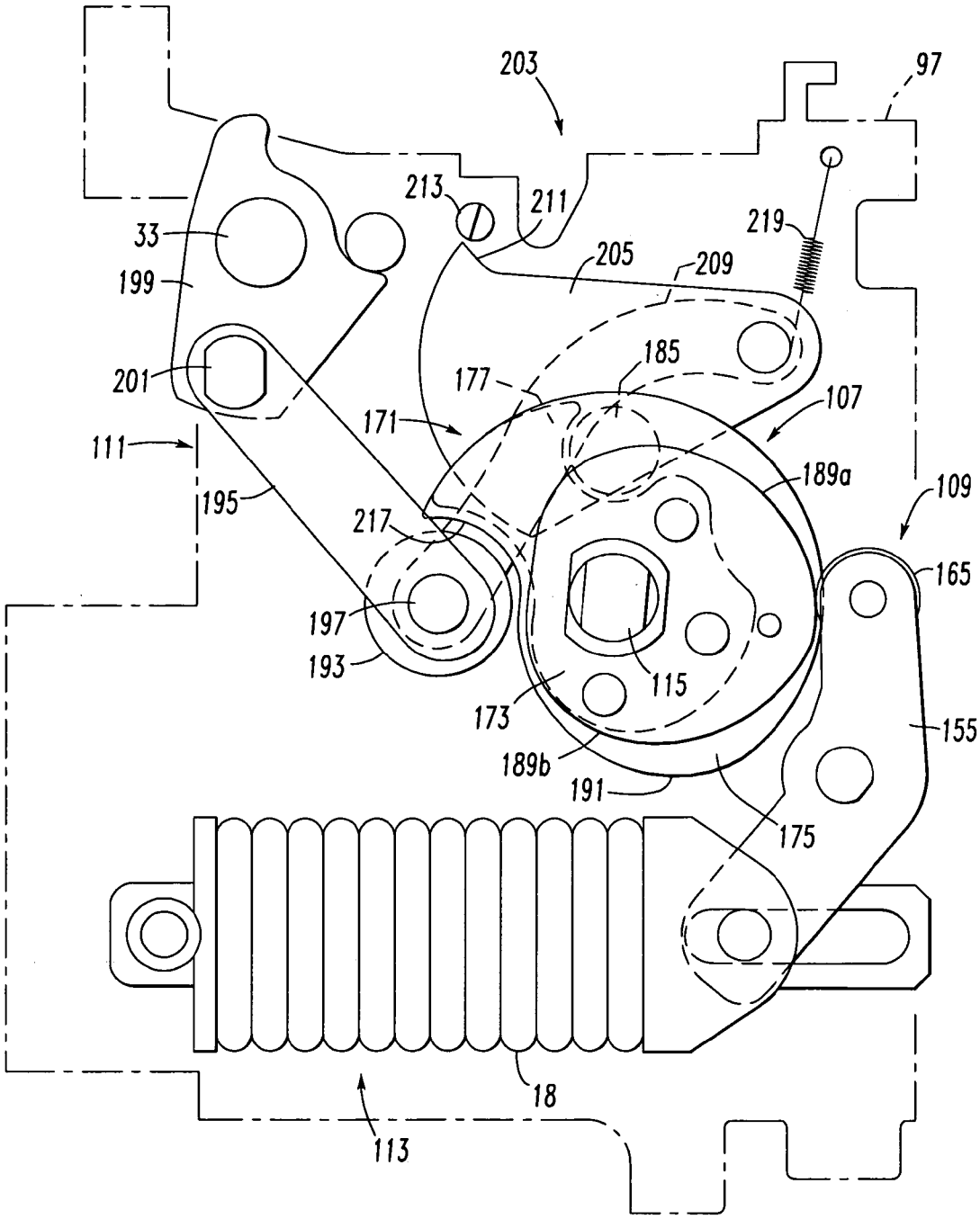
FIG. 9 is a view similar to FIG. 8 shown with the contacts open and the close spring charged.
Figure 10:
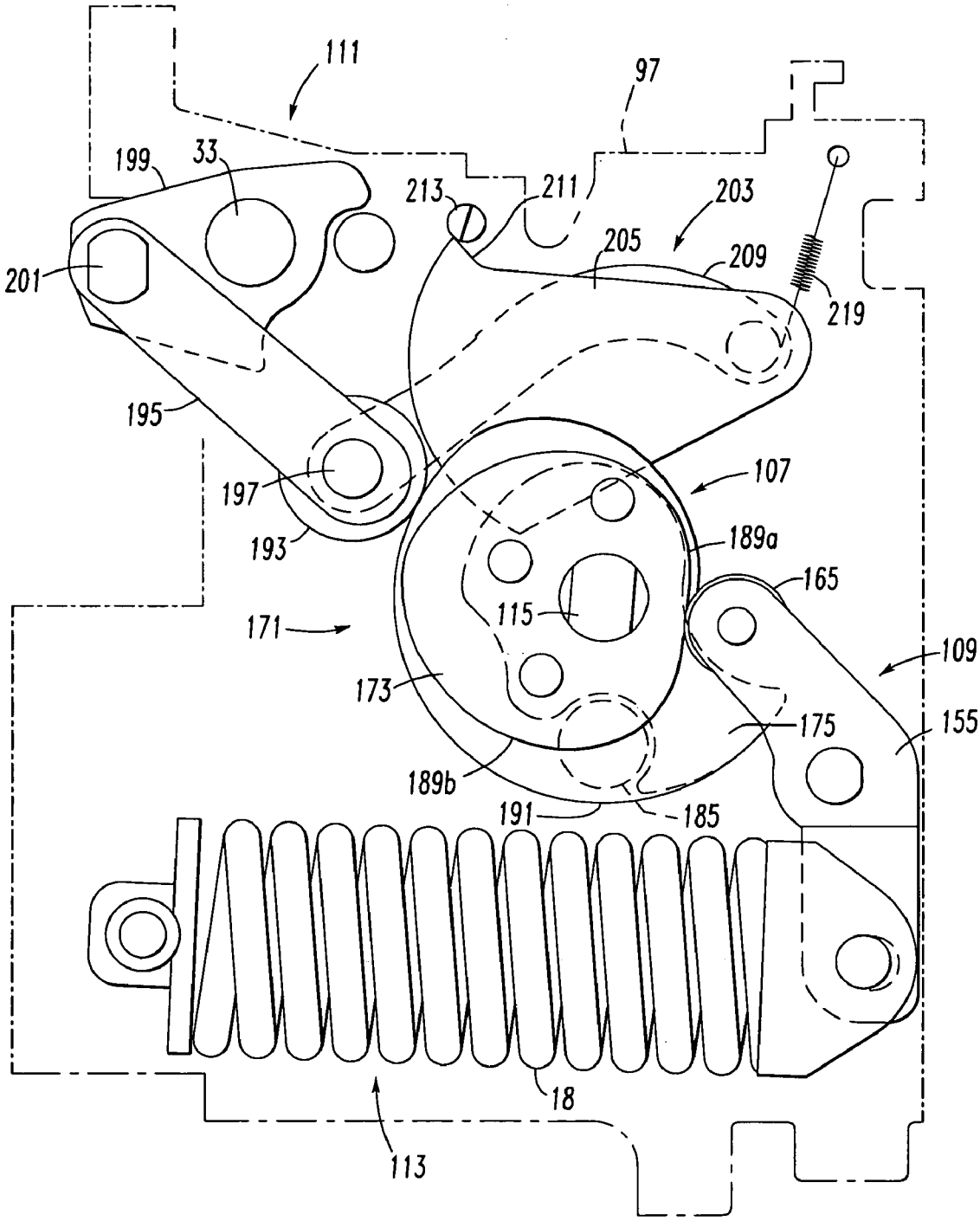
FIG. 10 is a view similar to FIG. 8 shown with the contacts closed and the close spring discharged.

The sequence of charging and discharging the close spring 18 can be understood by reference to FIGS. 8–11. It should be understood that there are two conditions for two components; the close spring 18 which may be charged or discharged, and the main contacts 43 which may be open or closed. Thus, FIGS. 8–11 show the four combinations of these conditions. That is, in FIG. 8, the main contacts 43 (not shown) are in the open position and the close spring 18 is discharged. In FIG. 9, the close spring 18 is charged and the main contacts 43 (not shown) remain open. In FIG. 10, the close spring 18 has been discharged to close the main contacts 43 (not shown). Finally, in FIG. 11, the main contacts 43 (not shown) remain closed and the close spring 18 has been charged. A detailed description of the sequence to charge the close spring 18, close the main contacts 43, and charge the close spring 18 again follows.

In FIG. 8 the mechanism is shown in the discharged open position, that is, the close spring 18 is discharged and the main contacts 43 are open. It can be seen that the cam member 171 is positioned so that the charge cam 173 has its smallest radius in contact with the rocker rollers 165. Thus, the rocker 155 is rotated to a full counterclockwise position and the close spring 18 is at its maximum extension. It can also be seen that the trip mechanism 203 is not latched so that the drive roller 193 is floating although resting against the drive cam 175. As the cam shaft 115 is rotated clockwise manually by the handle 31 or through operation of the charge motor (not shown) the charge portion 189*a* of the charge profile on the charge cam 173 which progressively increases in diameter, engages the rocker roller 165 and rotates the rocker 155 clockwise to compress the spring 18. As mentioned, the configuration of this charge portion 189*a* of the profile is selected so that a constant torque is required to compress the spring 18. During this charging of the close spring 18, the driver roller 193 is in contact with a portion of the drive cam profile 191 which has a constant radius so that the drive roller 193 continues to float.

Moving now to FIG. 9, as the close spring 18 becomes fully charged, the drive roller 193 falls off of the drive cam profile 191 into a recess 217. This permits the reset spring 219 to rotate the hatchet plate 205 counterclockwise until the latch ledge 211 passes slightly beyond the trip D shaft 213. This raises the pivot point of the banana link 209 on the hatchet plate 205 so that the drive roller 193 is raised to a position where it rests beneath the recess 215 in the drive cam 175. At the same time, the rocker rollers 165 reach a point just after 170° rotation of the cam member 171 where they enter the charge portion 189*b* of the charge cam profile 189. On this portion 189*b* of the charge cam profile 189, the radius of the charge cam 173 in contact with the rocker rollers 165 decreases in radius with clockwise rotation of the cam member 171. Thus, the close spring 18 applies a force tending to continue rotation of the cam member 171 in the clockwise direction. However, a close prop (not shown in FIG. 9) which is part of a close prop mechanism, described fully in U.S. Pat. No. 6,072,136, engages the stop roller 185 and prevents further rotation of the cam member 171. Thus, the close spring 18 remains fully charged ready to close the main contacts 43 of the circuit breaker 1.

The main contacts 43 of the circuit breaker 1 are closed by release of the close prop. With the close prop disengaged from the stop roller 185, the spring energy is released to rapidly rotate the cam member 171 to the position shown in FIG. 10. As the cam member 171 rotates, the drive roller 193 is engaged by the cam profile 191 of the drive cam 175. The radius of this cam profile 191 increases with cam shaft rotation and since the banana link 209 holds the drive roller 193 in contact with this surface, the pole shaft 33 is rotated to close the main contacts 43 as described in connection with FIG. 2. At this point the latch ledge 211 engages the trip D latch 213 and the main contacts 43 are latched closed. If the circuit breaker 1 is tripped at this point by rotation of the trip D shaft 213 so that this latch ledge 211 is disengaged from the trip D shaft 213, the very large force generated by the compressed contact springs 87 (see FIG. 2) exerted through the main link 195 pulls the pivot point of the banana link 209 on the hatchet plate 205 clockwise downward as the hatchet plate 205 rotates about the hatchet pin assembly 207 (See FIG. 8) and the drive roller 193 drops free of the drive cam 175 allowing the pole shaft 33 to rotate and the main contacts 43 to open. With the main contacts 43 open and the close spring 18 discharged the mechanism would again be in the state shown in FIG. 8.

Figure 11:
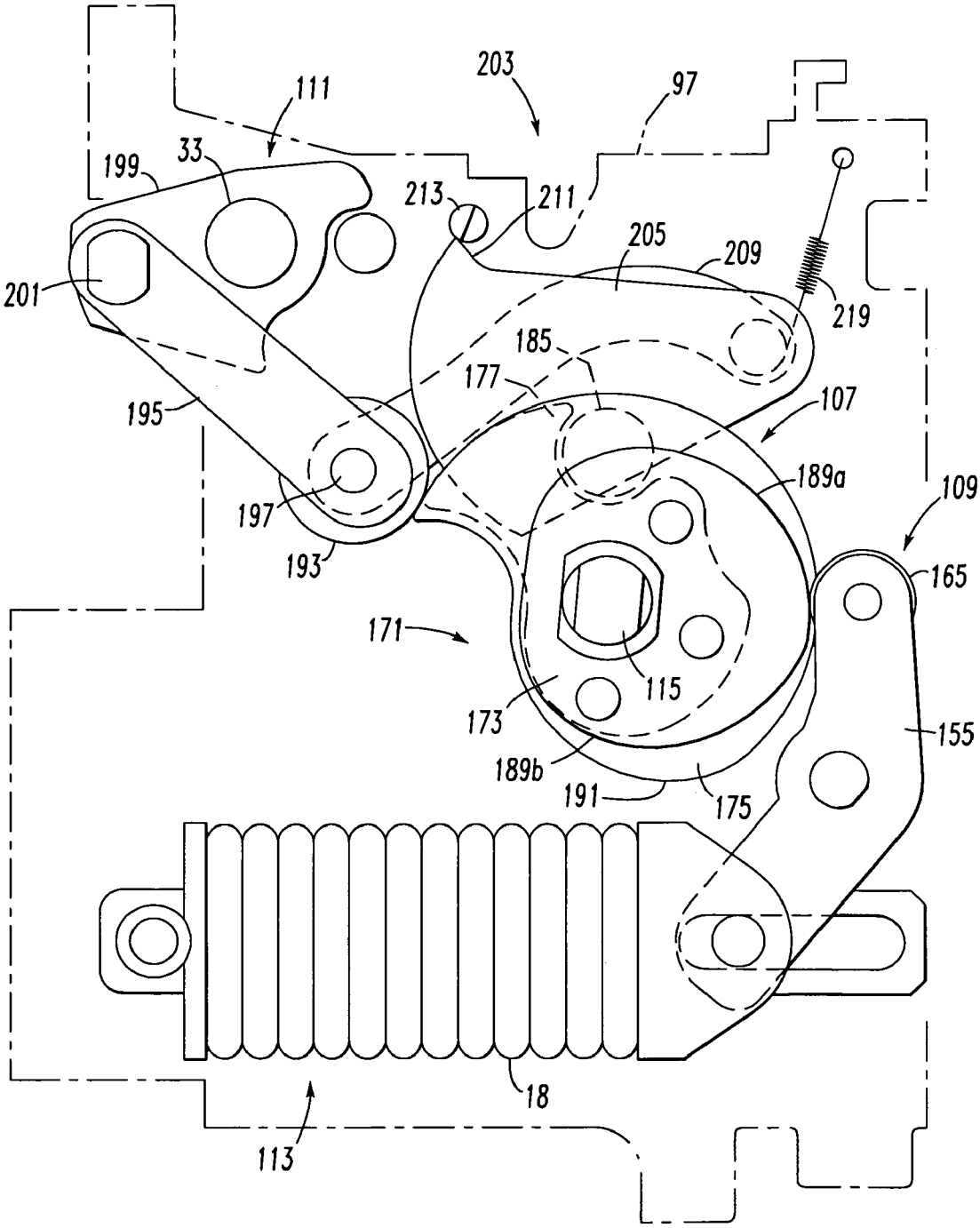
FIG. 11 is a view similar to FIG. 8 shown with the contacts closed and the close spring charged.

Typically, when the circuit breaker 1 is closed, the close spring 18 is recharged, again by rotation of the cam shaft 115 either manually or electrically. This causes the cam member 171 to return to the same position as in FIG. 9, but with the trip mechanism 203 latched, the banana link 209 keeps the drive roller 193 engaged with the drive cam profile 191 on the drive cam 175 as shown in FIG. 11. If the circuit breaker 1 is tripped at this point by rotation of the trip D latch 213 so that the hatchet plate 205 rotates clockwise, the drive roller 193 will drop down into the recess 215 in the drive cam 175 and the circuit breaker 1 will open.

Figure 12:
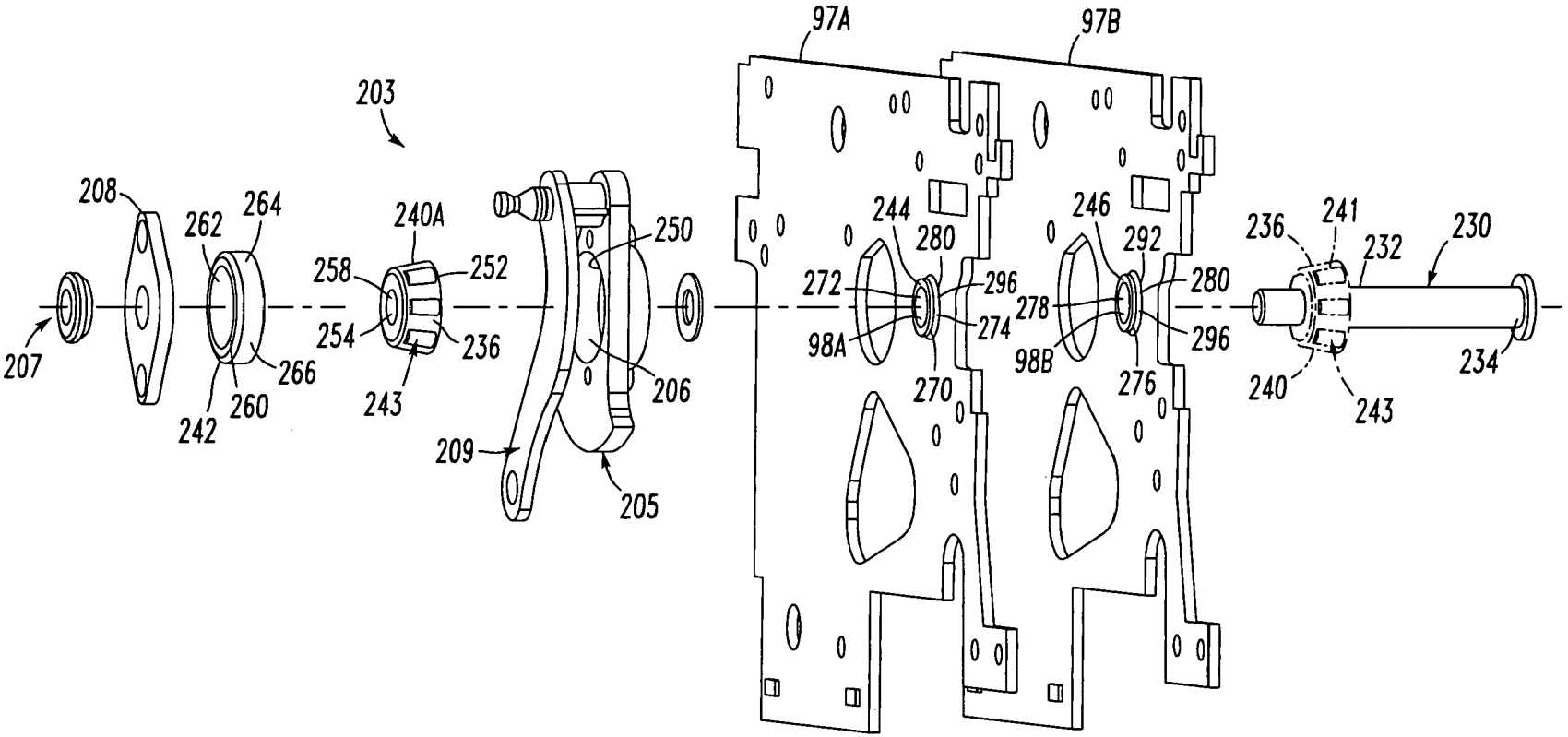
FIG. 12 is an exploded isometric view of a latch mechanism.

As shown in greater detail in FIG. 12, the trip mechanism 203 includes a hatchet plate 205 pivotally mounted on a hatchet pivot pin assembly 207 supported by a first side plate 97A and a second side plate 97B. Each side plate 97A, 97B includes a pivot pin opening 98A, 98B (respectively). The hatchet pivot pin assembly 207 includes a pin member 230 having a diameter and a longitudinal axis, as well as, at least a first pivoting surface 232, a second pivoting surface 234, and a third pivoting surface 236. The hatchet pivot pin assembly 207 may further include a hatchet plate bearing 240, a hatchet plate race 242, a first side plate race 244 and a second side plate race 246. The hatchet plate 205 includes an opening 250 sized to allow the pin member 230 to pass therethrough.

In one embodiment, the pin member 230 is rotatably coupled to the first and second side plates 97A, 97B by passing through the pivot pin openings 98A, 98B. In this embodiment, the pivot pin openings 98A, 98B are sized to securely, but rotatably, fit about the pivot pin member 230. That is, the pivot pin openings 98A, 98B are sized to be just larger than the pin member 230 diameter. In this embodiment the pin member 230 is pivotally coupled to the first side plate 97A at the first pivoting surface 232 and pivotally coupled to the second side plate 97B at the second pivoting surface 234. Thus, the pin member 230 may pivot about the longitudinal axis. The hatchet plate opening 250 is also sized to securely, but rotatably, fit about the pin member 230. The hatchet plate 205 is then rotatably disposed on the pin member 230 at the third pivoting surface 236. In this configuration, the hatchet plate 205 has at least two modes of rotation about a single axis, the pivot pin longitudinal axis. The modes of rotation include the hatchet plate 205 pivoting about pivot pin member 230 at the third pivoting surface 236 and both the hatchet plate 205 and the pivot pin member 230 pivoting, as a unit, at the first and second pivoting surfaces 232, 234.

In another embodiment, where the pivot pin assembly 207 includes a hatchet plate bearing 240 and a hatchet plate race 242, the hatchet plate bearing 240 is an integral portion of the pivot pin member 230 having an increased diameter. The hatchet plate bearing 240 is longitudinally positioned on said pivot pin, and sized, to engage the hatchet plate opening 250. Preferably, the hatchet plate race 242 is disposed in the hatchet plate opening 250. Thus, the hatchet plate opening 250 will be sized to accommodate both the hatchet plate race 242 and the hatchet plate bearing 240. The hatchet plate bearing 240 has an outer surface 241 that is the third pivoting surface 236. The hatchet plate race 242 is, preferably a torus 260 having an inner surface 262 and an outer surface 264. The hatchet plate bearing 240 is sized to securely, but rotatably, fit within the hatchet plate race 242. Thus, the hatchet plate bearing 240 outer surface 241, that is, the third pivoting surface 236, engages the hatchet plate race inner surface 262. Alternatively, the hatchet plate bearing 240 may be sized with a diameter smaller than the hatchet plate race 242 and include a plurality of raised portions 243. The raised portions 243 are sized to securely, but rotatably, fit within the hatchet plate race 242. Thus, the total surface area making contact between the hatchet plate bearing 240 and the hatchet plate race 242 is reduced, thereby reducing the amount of friction during rotation. Additionally, the hatchet plate bearing 240 and the hatchet plate race 242 may have a corresponding taper.

In the preferred embodiment, the hatchet plate race 242 is fixed to the hatchet plate 205. Thus, the hatchet plate 205 has at least two modes of rotation about a single axis, the pivot pin longitudinal axis. The modes of rotation include the hatchet plate 205 and hatchet plate race 242 pivoting about pivot pin member 230 at the third pivoting surface 236, i.e., at the hatchet plate bearing 240, as well as, both the hatchet plate 205 and the pivot pin member 230 pivoting, as a unit, at the first and second pivoting surfaces 232, 234. Alternatively, the hatchet plate race 242 may be free to rotate in the hatchet plate opening 250. Thus, the hatchet plate race outer surface 264 defines a fourth pivoting surface 266. The hatchet plate race 242 may include a double flange (not shown) to trap the hatchet plate race 242 on the hatchet pate 205, or, as shown, the hatchet plate 205 may form an indented pocket 206 about the hatchet plate opening 250. Thus, the hatchet plate race 242 may be trapped inside the pocket 206 by a cap 208. In this configuration, the hatchet plate 205 has three modes of rotation about the pivot pin member 230 axis, the two modes identified above, as well as the hatchet plate 205 pivoting about the hatchet plate race 242.

In another embodiment, the hatchet plate bearing 240A is a separate element from the pivot pin member 230. In this embodiment, the hatchet plate bearing 240A is a torus 252 having an inner surface 254 and an outer surface 256. The hatchet plate bearing torus 252 is sized to securely, but rotatably, fit within the hatchet plate race 242 with the hatchet plate bearing torus outer surface 256 acting as the third pivoting surface 236. Further, the pivot pin member 230 is sized to securely, but rotatably, fit within hatchet plate bearing torus 252. Thus, the hatchet plate bearing torus 252 is structured to pivot about said pivot pin member 230 and the hatchet plate bearing torus inner surface 254 defines a fifth pivoting surface 258.

In another embodiment, where the pivot pin assembly 207 includes a first side plate race 244 and a second side plate race 246. The first side plate race 244 is a torus 270 having an inner side 272 and an outer side 274. Similarly, the second side plate race 246 is a torus 276 having an inner side 278 and an outer side 280. The first side plate race 244 is disposed in the first side plate pivot pin opening 98A and the second side plate race 246 is disposed in the second side plate pivot pin opening 98B. Thus, the first and second pivot pin openings 98A, 98B are sized to accommodate both the pivot pin member 230 and the first side plate race 244 and second side plate race 246, respectively. The first side plate race 244 and second side plate race 246 are preferably fixed to the first and second side plates 97A, 97B. Thus, the first side plate race inner side 272 engages the first pivoting surface 232 and the second side plate race inner side 278 engages the second pivoting surface 234.

In an alternate embodiment, the first side plate race 244 and second side plate race 246 are free to rotate in the first and second pivot pin openings 98A, 98B. Thus, the first side plate race outer side 274 acts as a sixth pivoting surface 290 and the second side plate race outer side 280 acts as a seventh pivoting surface 292. Preferably, the first side plate race 244 and second side plate race 246 each include opposing flanges 296 that are disposed on opposite sides of the first and second side plates 97A, 97B, respectively. In this embodiment, the hatchet plate 205 and pivot pin assembly 207 have an additional mode of rotation about the pivot pin member 230 axis. That is, should the pivot pin member 230 become locked to the first side plate race 244 and second side plate race 246, the hatchet plate 205 and pivot pin assembly 207 may rotate as a complete unit, including the first side plate race 244 and second side plate race 246, within the first and second pivot pin openings 98A, 98B.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A trip mechanism for a circuit breaker, said circuit breaker including a first and second side plate, each of the side plates having a pivot pin opening, said trip mechanism comprising:

a hatchet plate having an opening;

a pivot pin assembly having a longitudinal axis and at least three pivoting surfaces, said pivot pin assembly including a pivot pin member with a first pivoting surface, a second pivoting surface, and a third pivoting surface;

said pivot pin member extending between said first and second side plates and being pivotally coupled to said first side plate at the first pivoting surface and pivotally coupled to said second side plate at the second pivoting surface;

said hatchet plate pivotally coupled to said pivot pin member with said pivot pin third pivoting surface disposed through said hatchet plate opening;

whereby said hatchet plate has at least two modes of rotation about a single axis, said modes of rotation including said hatchet plate pivoting about said pivot pin member at said third pivoting surface and said hatchet plate and said pivot pin member pivoting at said first and second pivoting surfaces.

2. The trip mechanism of claim 1 wherein:

said hatchet plate includes a race disposed in said hatchet plate opening, said hatchet plate race having an inner surface and an outer surface;

said pivot pin assembly includes a hatchet plate bearing longitudinally positioned on said pivot pin member, and sized, to engage said hatchet plate race inner surface;

said hatchet plate bearing having an outer surface defining said third pivoting surface.

3. The trip mechanism of claim 2 wherein:

said hatchet plate race is fixed to said hatchet plate; and said hatchet plate bearing is integral to said pivot pin member.

4. The trip mechanism of claim 3 wherein:

said hatchet plate bearing outer surface is tapered; and said hatchet plate race inner surface is tapered.

5. The trip mechanism of claim 2 wherein:

said hatchet plate bearing outer surface includes a plurality of raised portions;

said raised portions being structured to engage said hatchet plate race inner surface; and said raised portions defining said third pivoting surface.

6. The trip mechanism of claim 2 wherein said hatchet plate race is free to rotate in said hatchet plate opening and said hatchet plate race outer surface defines a fourth pivoting surface.

7. The trip mechanism of claim 2 wherein:

said hatchet plate bearing is a torus, separate from said pivot pin member, and having an inner surface and an outer surface; and said outer surface defining said third pivoting surface.

8. The trip mechanism of claim 7 wherein said torus inner surface defines a fifth pivoting surface and said torus is structured to pivot about said pivot pin member.

9. The trip mechanism of claim 8 wherein:

said pivot pin assembly includes a first side plate race and a second side plate race;

said first side plate race coupled to said first side plate and structured to engage said first pivoting surface; and said second side plate race coupled to said second side plate and structured to engage said second pivoting surface.

10. The trip mechanism of claim 9 wherein:

said first side plate race is a torus having an inner surface and an outer surface, said inner surface structured to engage said first pivoting surface and said outer surface defining a sixth pivoting surface;

said first side plate race being pivotally coupled to said first side plate;

said second side plate race is a torus having an inner surface and an outer surface, said inner surface structured to engage said second pivoting surface and said outer surface defining a seventh pivoting surface; and said second side plate race being pivotally coupled to said second side plate.

11. The trip mechanism of claim 1 wherein:

said pivot pin assembly includes a first side plate race and a second side plate race;

said first side plate race coupled to said first side plate and structured to engage said first pivoting surface; and said second side plate race coupled to said second side plate and structured to engage said second pivoting surface.

12. The trip mechanism of claim 11 wherein:

said first side plate race is a torus having an inner surface and an outer surface, said inner surface structured to engage said first pivoting surface and said outer surface defining a sixth pivoting surface;

said first side plate race being pivotally coupled to said first side plate;

said second side plate race is a torus having an inner surface and an outer surface, said inner surface structured to engage said second pivoting surface and said outer surface defining said a seventh pivoting surface; and said second side plate race being pivotally coupled to said second side plate.

13. A circuit breaker comprising:

a housing;

at least one pair of main contacts disposed in said housing;

an operating mechanism coupled to said at least one pair of main contacts and structured to separate said at least one pair of main contacts, said operating mechanism including a trip mechanism;

said trip mechanism having a hatchet plate with an opening, a pivot pin assembly having pivot pin member with a longitudinal axis and at least three pivoting surfaces, a first pivoting surface, a second pivoting surface, and a third pivoting surface, said pivot pin member extending between said first and second side plates and being pivotally coupled to said first side plate at a first pivoting surface and pivotally coupled to said second side plate at a second pivoting surface, said hatchet plate pivotally coupled to said pivot pin member with said pivot pin third pivoting surface disposed through said hatchet plate opening, and whereby said hatchet plate has at least two modes of rotation about a single axis, said modes of rotation including said hatchet plate pivoting about said pivot pin member at said third pivoting surface and said hatchet plate and said pivot pin member pivoting at said first and second pivoting surfaces.

14. The circuit breaker of claim 13 wherein:

said hatchet plate includes a race disposed in said hatchet plate opening, said hatchet plate race having an inner side and an outer side;

said pivot pin assembly includes a hatchet plate bearing longitudinally positioned on said pivot pin member, and sized, to engage said hatchet plate race inner side;

said hatchet plate bearing having an outer surface defining said third pivoting surface.

15. The circuit breaker of claim 14 wherein:

said hatchet plate race is fixed to said hatchet plate; and said hatchet plate bearing is integral to said pivot pin member.

16. The circuit breaker of claim 15 wherein:

said hatchet plate bearing outer surface is tapered; and said hatchet plate race inner surface is tapered.

17. The circuit breaker of claim 16 wherein:

said hatchet plate bearing outer surface includes a plurality of raised portions;

said raised portions being structured to engage said hatchet plate race inner surface; and said raised portions defining said third pivoting surface.

18. The circuit breaker of claim 16 wherein said race is free to rotate in said hatchet plate opening and said hatchet plate race outer surface defines a fourth pivoting surface.

19. The circuit breaker of claim 16 wherein:

said hatchet plate bearing is a torus, separate from said pivot pin member, and having an inner surface and an outer surface; and said outer surface defining said third pivoting surface.

20. The circuit breaker of claim 19 wherein said torus inner surface defines a fifth pivoting surface and said torus is structured to pivot about said pivot pin member.

21. The circuit breaker of claim 20 wherein:

said pivot pin assembly includes a first side plate race and a second side plate race;

said first side plate race coupled to said first side plate and structured to engage said first pivoting surface; and said second side plate race coupled to said second side plate and structured to engage said second pivoting surface.

22. The circuit breaker of claim 21 wherein:

said first side plate race is a torus having an inner surface and an outer surface, said inner surface structured to engage said first pivoting surface and said outer surface defining a sixth pivoting surface;

said first side plate race being pivotally coupled to said first side plate;

said second side plate race is a torus having an inner surface and an outer surface, said inner surface structured to engage said second pivoting surface and said outer surface defining a seventh pivoting surface; and said second side plate race being pivotally coupled to said second side plate.

23. The circuit breaker of claim 13 wherein:

said pivot pin assembly includes a first side plate race and a second side plate race;

said first side plate race coupled to said first side plate and structured to engage said first pivoting surface; and said second side plate race coupled to said second side plate and structured to engage said second pivoting surface.

24. The circuit breaker of claim 23 wherein:

said first side plate race is a torus having an inner surface and an outer surface, said inner surface structured to engage said first pivoting surface and said outer surface defining a sixth pivoting surface;

said first side plate race being pivotally coupled to said first side plate;

said second side plate race is a torus having an inner surface and an outer surface, said inner surface structured to engage said second pivoting surface and said outer surface defining a seventh pivoting surface; and said second side plate race being pivotally coupled to said second side plate.

* * * * *